US007470035B1

(12) United States Patent
Benitez

(10) Patent No.: US 7,470,035 B1
(45) Date of Patent: Dec. 30, 2008

(54) VISION ASSISTANCE APPARATUS

(76) Inventor: Eduardo Benitez, 2000 S. Bay Shore Dr., Miami, FL (US) 33133

( * ) Notice: Subject to any disclaimer, the term of this patent is extended or adjusted under 35 U.S.C. 154(b) by 0 days.

(21) Appl. No.: 11/850,270

(22) Filed: Sep. 5, 2007

(51) Int. Cl.
*F21K 2/06* (2006.01)

(52) U.S. Cl. ..... 362/101; 362/34

(58) Field of Classification Search ..... 362/101, 362/34
See application file for complete search history.

(56) References Cited

U.S. PATENT DOCUMENTS 4,687,113 A 8/1987 Reeve
4,814,949 A 3/1989 Elliott
5,044,509 A * 9/1991 Petrosky et al. ..... 215/366
5,171,081 A * 12/1992 Pita et al. ..... 362/34
6,474,467 B1 * 11/2002 Kurdian ..... 206/222
6,874,906 B1 4/2005 Dorney
7,040,776 B2 5/2006 Harrell et al.
2005/0190548 A1 * 9/2005 Cohen et al. ..... 362/34
2005/0270762 A1 12/2005 Cohen et al.
2006/0126322 A1 * 6/2006 Jordan ..... 362/34

* cited by examiner

*Primary Examiner*—Laura Tso
(74) *Attorney, Agent, or Firm*—Crossley Patent Law; Mark A Crossley

(57) ABSTRACT

A vision assistance apparatus that allows a removable cap on a plastic bottle to glow in the dark once it has been removed from the plastic bottle. The removable cap originally comes attached to the bottle on a binder through a series of attachments broken up by a series of perforations. Once the removable cap is removed, the attachments break, allowing the individual to detach the cap. Once the circular portion of the removable cap is removed, then two different sets of chemicals can be mixed together by having the individual manipulate the circular portion of the removable cap, thereby breaking a seal in between the two volumes of chemicals and causing the two different sets of chemicals to be mixed together. The two chemicals, when mixed together, are chemiluminescent and will produce an amount of light for a certain amount of time.

4 Claims, 2 Drawing Sheets

VISION ASSISTANCE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved vision assistance apparatus that allows a removable cap on a plastic bottle to glow in the dark once it has been removed from the plastic bottle.

DESCRIPTION OF THE PRIOR ART

U.S. application Ser. No. 2005/0270762, filed by Cohen et al., discloses a changeable appearance device that is particularly useful as a chemiluminescent vessel.

U.S. Pat. No. 7,040,776, issued to Harrell et al., discloses a self-contained illumination device for medicine containers.

U.S. Pat. No. 6,874,906, issued to Dorney, discloses a chemiluminescent lid for a cup.

U.S. Pat. No. 4,814,949, issued to Elliott, discloses a sealed chemiluminescent device.

U.S. Pat. No. 4,687,113, issued to Reeve, discloses a tamper-evidence closure having a tamper-indicating disc which may be bright or a luminescent color.

SUMMARY OF THE INVENTION

The present invention concerns that of a new and improved vision assistance apparatus that allows a removable cap on a plastic bottle to glow in the dark once it has been removed from the plastic bottle. The removable cap originally comes attached to the bottle on a binder through a series of attachments broken up by a series of perforations. Once the removable cap is removed, the attachments break, allowing the individual to detach the cap. Once the circular portion of the removable cap is removed, then two different sets of chemicals can be mixed together by having the individual manipulate the circular portion of the removable cap, thereby breaking a seal in between the two volumes of chemicals and causing the two different sets of chemicals to be mixed together. The two chemicals, when mixed together, are chemiluminescent and will provide an amount of light for a certain amount of time.

There has thus been outlined, rather broadly, the more important features of a vision assistance apparatus that the detailed description thereof that follows may be better understood and in order that the present contribution to the art may be better appreciated. There are, of course, additional features of the vision assistance apparatus that will be described hereinafter and which will form the subject matter of the claims appended hereto.

In this respect, before explaining at least one embodiment of the vision assistance apparatus in detail, it is to be understood that the vision assistance apparatus is not limited in its application to the details of construction and to the arrangements of the components set forth in the following description or illustrated in the drawings. The vision assistance apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and system for carrying out the several purposes of the present vision assistance apparatus. It is important, therefore, that the claims be regarded as including such equivalent constructions insofar as they do not depart from the spirit and scope of the present invention.

It is therefore an object of the present invention to provide a vision assistance apparatus which has all of the advantages of the prior art and none of the disadvantages.

It is another object of the present invention to provide a vision assistance apparatus which may be easily and efficiently manufactured and marketed.

It is another object of the present invention to provide a vision assistance apparatus which is of durable and reliable construction.

It is yet another object of the present invention to provide a vision assistance apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
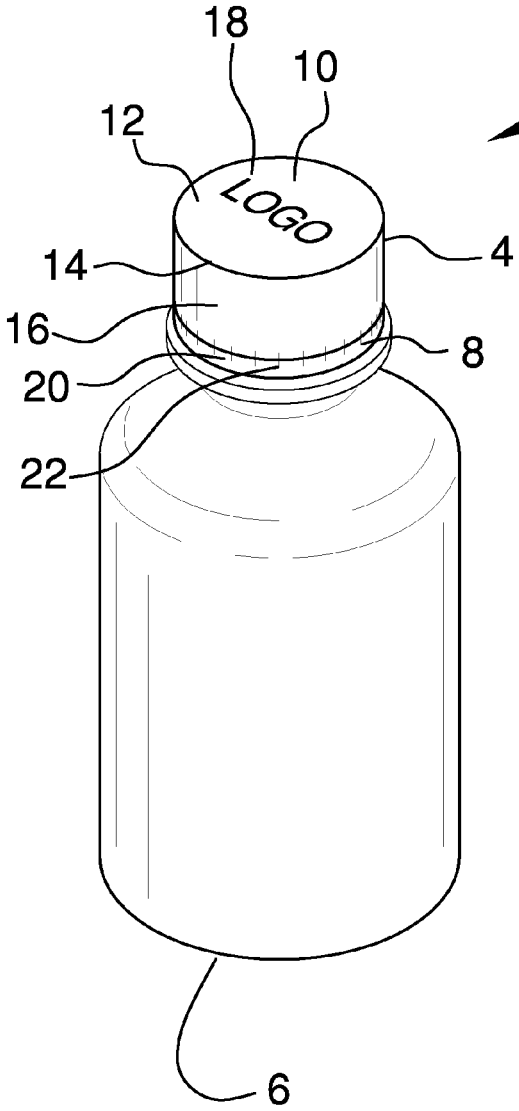
FIG. 1 shows a front top perspective view of the vision assistance apparatus as it would appear with the removable cap attached to the binder, prior to the two volumes of chemical being mixed together.
Figure 2:
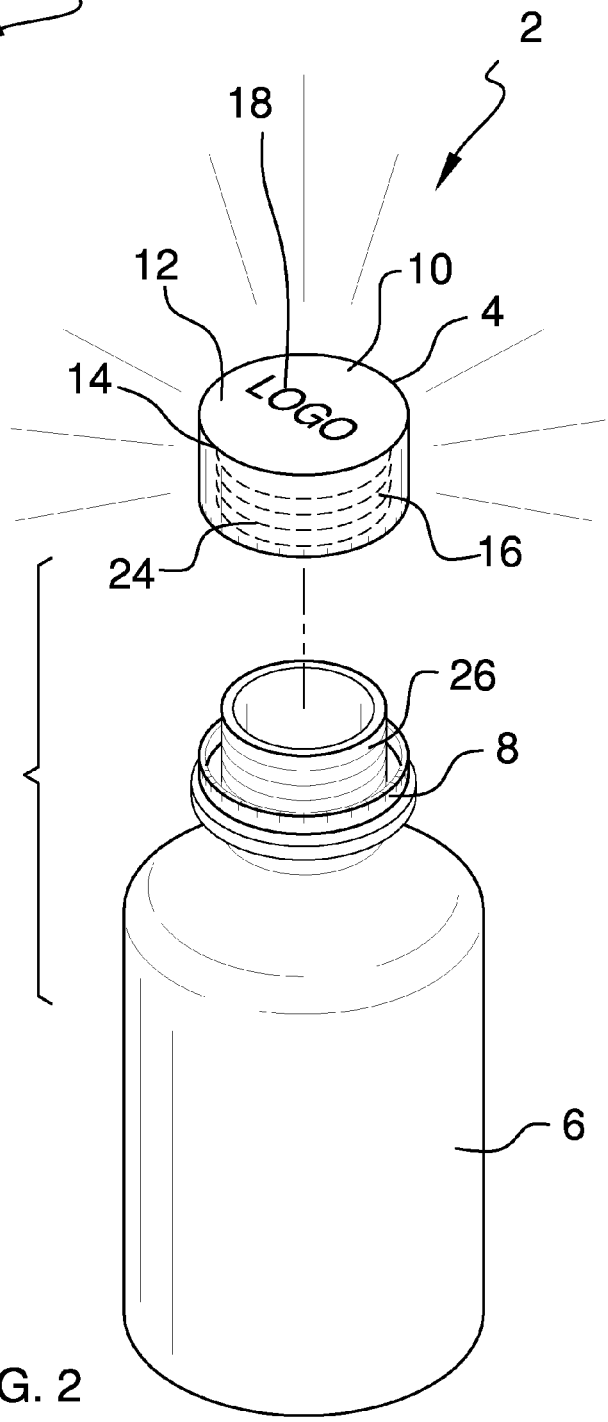
FIG. 2 shows a front top perspective view of the vision assistance apparatus as it would appear with the removable cap having been removed from the binder, after the two volumes of chemical being mixed together.
Figure 3:
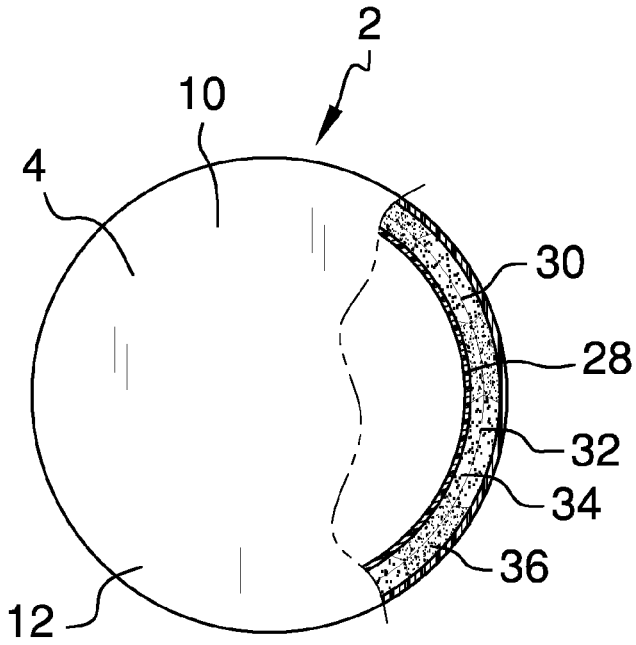
FIG. 3 shows a top view of the removable cap, highlighting the two different volumes of chemicals stored within the removable cap.
Figure 4:
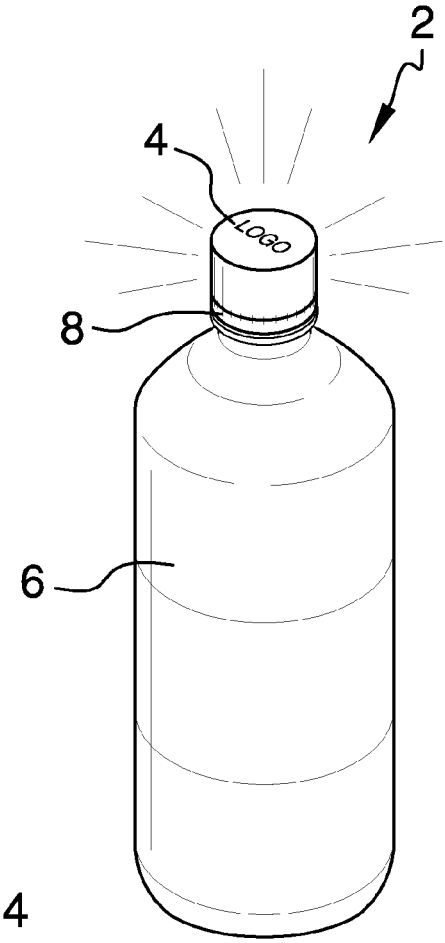
FIG. 4 shows a front top perspective view of the vision assistance apparatus as it would appear with the removable cap attached to the binder, after the volumes of chemical being mixed together.

With reference now to the drawings, and in particular to FIGS. 1 through 4 thereof, a new vision assistance apparatus embodying the principles and concepts of the present invention and generally designated by the reference numeral 2 will be described.

As best illustrated in FIGS. 1 through 4, the vision assistance apparatus 2 comprises a removable cap 4 that is attached to a bottle 6 through a connected binder 8. The removable cap 4 has a base 10 that has two surfaces comprising an upper surface 12 and a lower surface 14. The removable cap 4 further includes a continuous side surface 16 attached to the lower surface 14. Optionally, a logo 18 can be placed on the upper surface 12 of the base 4.

The removable cap 4 is attached to the binder 8 through a plurality of attachments 20, with each two successive attachments 20 being separated by a perforation 22. The attachments 20 connect the continuous side surface 16 to the binder 8. To remove the cap 4 from the binder 8, an individual can firmly grasp the cap 4 and twist it in a counterclockwise manner, causing it to separate from the binder 8.

The removable cap 4, when being attached to the bottle 6, also has a series of internal threads 24 that are connectable to a plurality of external threads 26 that are attached to the bottle 6. Therefore, even after the cap 4 is separated from the binder 8, the cap 4 must be turned several times in a counterclockwise manner before it can be entirely removed from the bottle 6.

The continuous side surface 16 portion of the cap 4 internally houses two separate compartments that circumferentially travel around the entire circumference of the continuous side surface 16, and these two sections are an interior compartment 28 and an exterior compartment 30. The interior compartment 28 and the exterior compartment 30 are separated by a seal 32. The seal 32 circumferentially travels around the entire circumference of the continuous side surface of the cap within the continuous side surface 16 of the cap 4. The interior compartment 28 houses a volume of a first chemical 34, while the exterior compartment 30 houses a volume of a second chemical 36.

First chemical 34 and second chemical 36, individually, do not contain any chemiluminescent properties. However, once the cap 4 is grasped and removed from the bottle 6, the seal 32 is broken through the handling of the cap 4 by the individual. This, in turn, causes the first chemical 34 and second chemical 36 to intermix. Since first chemical 34 and second chemical 36 are designed to be two components of a chemiluminescent system, the intermixing of these two chemicals will cause the cap 4 to emit a low level amount of lights for a short amount of time (potentially up to a few hours). After this time period is up, the chemiluminescent properties of the cap 4 would be gone, as the mixture of the two chemicals would have reached equilibrium.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A vision assistance apparatus comprising a bottle, means for illuminating the area in the immediate vicinity of the bottle, a cap comprising a base, the base having two surfaces comprising an upper surface and a lower surface, and a continuous side surface attached to the lower surface of the base, and means for attaching the cap to the bottle comprising a binder located surrounding the bottle, a plurality of attachments, the attachments connecting the continuous side surface of the cap to the binder, and a plurality of perforations, wherein one perforation is located in between each successive pair of attachments, a plurality of external threads attached to the bottle, a plurality of internal threads located within the cap, wherein the plurality of internal threads located within the cap can be threadably attached to the plurality of external threads attached to the bottle, wherein the means for illuminating the area in the immediate vicinity of the bottle further comprises a pair of compartments located within the continuous side surface of the cap, wherein each compartment travels around the entire circumference of the continuous side surface of the cap, said compartments comprising an exterior compartment and an interior compartment, means for separating the two compartments, a volume of a first chemical located within the exterior compartment, and a volume of a second chemical located within the interior compartment.

2. A vision assistance apparatus according to claim 1 wherein the means for separating the two compartments further comprises (a) a seal located in between the exterior compartment and the interior compartment, (b) wherein the seal circumferentially travels around the entire circumference of the continuous side surface of the continuous side surface of the cap within the cap.

3. A vision assistance apparatus according to claim 2 wherein the means for illuminating the area in the immediate vicinity of the bottle comprises the steps of (a) grasping the cap and turning it counterclockwise until the cap is detached from the binder, (b) removing the cap from contact with the bottle, (c) squeezing the cap hard enough so that the seal in between the exterior compartment and the interior compartment breaks, allowing the volume of the first chemical and the volume of the second chemical to mix, (d) wherein the first chemical and the second chemical are two components of a chemiluminescent system, (e) further wherein the intermixing of the first chemical and the second chemical will cause the resulting mixture to glow for a period of time, thereby causing the cap to emit a low level glow for a period of time.

4. A vision assistance apparatus comprising:

a bottle;

means for illuminating the area in the immediate vicinity of the bottle;

a cap, wherein the cap further comprises (i) a base, the base having two surfaces comprising an upper surface and a lower surface, and (ii) a continuous side surface attached to the lower surface of the base, means for attaching the cap to the bottle, said means comprising (i) a binder located surrounding the bottle, (ii) a plurality of attachments, the attachments connecting the continuous side surface of the cap to the binder, (iii) a plurality of perforations, wherein one perforation is located in between each successive pair of attachments, (iv) a plurality of external threads attached to the bottle, (v) a plurality of internal threads located within the cap, (vi) wherein the plurality of internal threads located within the cap can be threadably attached to the plurality of external threads attached to the bottle, wherein the means for illuminating the area in the immediate vicinity of the bottle further comprises a pair of compartments located within the continuous side surface of the cap, wherein each compartment travels around the entire circumference of the continuous side surface of the cap, said compartment comprising an exterior compartment and an interior compartment, means for separating the two compartments, said means further comprising (a) a seal located in between the exterior compartment and the interior compartment, (b) wherein the seal circumferentially travels around the entire circumference of the continuous side surface of the continuous side surface of the cap within the cap, a volume of a first chemical located within the exterior compartment, a volume of a second chemical located within the interior compartment, wherein the means for illuminating the area in the immediate vicinity of the bottle comprises the steps of (i) grasping the cap and turning it counterclockwise until the cap is detached from the binder, (ii) removing the cap from contact with the bottle, (iii) squeezing the cap hard enough so that the seal in between the exterior compartment and the interior compartment breaks, allowing the volume of the first chemical and the volume of the second chemical to mix, (iv) wherein the first chemical and the second chemical are two components of a chemiluminescent system, (v) further wherein the intermixing of the first chemical and the second chemical will cause the resulting mixture to glow for a period of time, thereby causing the cap to emit a low level glow for a period of time.

* * * * *